United States Patent [19]

Suzuki et al.

[11] Patent Number: 4,846,633

[45] Date of Patent: Jul. 11, 1989

[54] VARIABLE-CAPACITY SCROLL-TYPE COMPRESSOR

[75] Inventors: Yasuyuki Suzuki; Tetsuzo Matsugi; Toshiyuki Nakamura; Masahiro Sugihara, all of Wakayama, Japan

[73] Assignee: Mitsubishi Denki Kabushiki Kaisha, Japan

[21] Appl. No.: 124,555

[22] Filed: Nov. 24, 1987

[30] Foreign Application Priority Data

Nov. 27, 1986 [JP] Japan ..... 61-283406

[51] Int. Cl.[4] ..... F04B 49/00

[52] U.S. Cl. ..... 417/310; 417/440

[58] Field of Search ..... 417/310, 440, 308; 418/55; 251/63

[56] References Cited

U.S. PATENT DOCUMENTS

| | | | |
|---|---|---|---|
| 4,065,279 | 12/1977 | McCullough | 62/510 |
| 4,383,805 | 5/1983 | Teegarden et al. | 417/308 |
| 4,496,293 | 1/1985 | Nakamura et al. | 417/371 |
| 4,514,150 | 4/1985 | Hiraga et al. | 417/440 |
| 4,564,339 | 1/1986 | Nakamura et al. | 417/366 |
| 4,575,320 | 3/1986 | Kobayashi et al. | 418/55 |

FOREIGN PATENT DOCUMENTS

| | | | |
|---|---|---|---|
| 801945 | 8/1936 | France | 417/559 |
| 57-110789 | 7/1982 | Japan | 417/440 |
| 60-75796 | 4/1985 | Japan | 417/310 |

*Primary Examiner*—Carlton R. Croyle
*Assistant Examiner*—Leonard P. Walnoha
*Attorney, Agent, or Firm*—Leydig, Voit & Mayer

[57] ABSTRACT

A scroll-type compressor has a stationary scroll and a moving scroll which is orbitted about the center of the stationary scroll. A valve chamber, a first by-pass, and a second by-pass are formed in the end plate of the stationary scroll. The first by-pass communicates between the inside of the valve chamber and one of the compression chambers formed by the scrolls, and the second by-pass communicates between the inside of the valve chamber and the outside of the end plate of the stationary scroll. The valve chamber houses a plate-shaped valve which is moved by fluid pressure between a closed position, in which it blocks the by-passes, and an open position, in which working fluid can flow between the two by-passes. Working fluid at either discharge pressure or suction pressure can be introduced into the valve chamber to the rear of the valve through a connecting pipe which is connected to the valve chamber and a 3-way solenoid valve.

4 Claims, 3 Drawing Sheets

VARIABLE-CAPACITY SCROLL-TYPE COMPRESSOR

BACKGROUND OF THE INVENTION

This invention relates to a scroll-type positive displacement machine, and more particularly, it relates to a scroll-type compressor whose capacity can be varied.

A scroll-type compressor is a positive displacement rotary compressor comprising two interfitting elements generally referred to as scrolls. Each scroll comprises a disk-shaped end plate and a thin-walled member, generally referred to as a spiral wrap, which projects perpendicularly from one surface of the end plate and curves outwards from the center of the end plate in the shape of an involute or other type of spiral. The two scrolls are disposed with the end plates parallel and the spiral wraps interfitting with one another so as to be in line contact with one another at a plurality of locations. The surfaces of the end plates and the spiral wraps define a plurality of spiral compression chambers between the locations of line contact between the spiral wraps. If the scrolls are rotated with respect to one another in the proper direction while maintaining the line contact between the spiral wraps, the compression chambers are gradually moved towards the centers of the scrolls with an accompanying decrease in volume. Fluid is introduced into the compression chambers at the radially outer end of the scrolls and then removed at a higher pressure from a discharge port at the center of the scrolls.

Recently, scroll-type compressors have come to be used in air conditioners. When the temperature of the room which is being heated or cooled by the air conditioner reaches a predetermined temperature, the motor for the compressor is stopped. When the room temperature again deviates from the predetermined temperature, the thermostat restarts the compressor motor, and the air conditioner again performs cooling or heating. However, when the compressor is restarted to compensate for a small temperature deviation, the air conditioner need be operated at only a very low capacity to restore the room temperature to the predetermined temperature. Nevertheless, the capacity of most conventional scroll-type compressors is fixed, and they are therefore operated at full capacity even when only a small output is required. Modern air conditioners are controlled by microcomputers which are highly sensitive to temperature variations, and the air conditioner compressor is frequently turned on and off. As a result, a large load is intermittently applied to the compressor motor. This frequent application of a large load shortens the life of the motor.

Furthermore, the ratio of the suction pressure to the discharge pressure of air conditioners varies with the room temperature and the outside temperature during both cooling and heating. A compressor is designed to run with maximum efficiency at a certain optimal pressure ratio. If the pressure ratio varies in the above-described manner from the optimal pressure ratio, power losses develop during compression and the efficiency of the compressor decreases.

In order to solve such problems, a number of scroll-type compressors having variable capacity have been proposed. For example, U.S. Pat. No. 4,514,150 discloses a scroll-type compressor with a displacement adjusting mechanism. The end plate of a fixed scroll has a plurality of holes formed therein which extend between the compression chambers of the compressor and a suction chamber. The holes are opened and closed by a control mechanism in the form of valve plates and a magnetic coil which opens and closes the valve plates. When the holes are closed by the control mechanism, the compressor operates at full capacity, and when the holes are opened, a portion of the working fluid in the compression chambers is bypassed to the suction chamber, whereby the capacity of the compressor is reduced.

U.S. Pat. No. 4,383,805 discloses a scroll-type compressor having unloader means for selectively varying its capacity. The unloader means comprises passages which are formed in the end plate of one of the scrolls and which extend between the compression chambers and a space which is at suction pressure. The passages are opened and closed by spring-loaded plunger-type valves which are operated by the application of discharge pressure to one side of the valves. With the passages closed by the valves, the compressor operates at full capacity, and with the passages open, working fluid escapes from the compression chambers to the space at suction pressure and the capacity of the compressor is reduced.

However, in both of the above-described inventions, the valve mechanism which opens and closes the holes or passageways between the compression chambers and a suction chamber is a complicated and expensive mechanism and lacks reliability. Furthermore, as the valve mechanism is bulky, the compressor becomes too large to be housed in the sealed shell of a conventional scroll-type compressor which is not equipped with a capacity control mechanism. Thus, the cost of conventional scroll-type compressors with capacity control mechanisms is extremely high.

SUMMARY OF THE INVENTION

It is therefore an object of the present invention to provide a scroll-type compressor which is equipped with a capacity control mechanism, to be simple in structure, economical, reliable, and compact.

A scroll-type compressor in accordance with the present invention is of the type having a stationary scroll and an orbiting scroll which interfits with the stationary scroll so as to form a plurality of compression chambers and which is orbited around the center of the stationary scroll to produce compression. The capacity of the compressor is varied by means of by-pass passages which communicate between the inside of the compression chambers and a portion of the compressor having at suction pressure via valve chambers. Each valve chamber houses a plate-shaped valve. The by-pass passage are opened and closed by the valves whose openings and closings are performed by introducing either high-pressure or low-pressure fluid into the valve chambers.

A scroll-type compressor in accordance with the present invention comprises a stationary scroll having an end plate with a discharge portion being formed at the center thereof and a spiral wrap formed on the end plate; an orbiting scroll having an end plate, and a spiral wrap formed on the end plate and is combined with the spiral wrap of the stationary scroll so as to define a plurality of compression chambers; means for orbitting the orbiting scroll about the center of the stationary scroll while preventing it from rotating on its own axis; a valve chamber formed in the end plate of the stationary scroll having a valve seat; a first by-pass passage formed inside the end plate of the stationary scroll and providing a path for communicating between the inside of one of the compression chambers and the inside of the valve chamber; a second by-pass passage formed inside the end plate of the stationary scroll and providing a path for communicating between the inside of the valve chamber and one of the outer surfaces of the stationary scroll; a plate-shaped valve housed in the valve chamber and operable to move between a seated position on the valve seat to close the communicating paths provided by the first and second by-pass passages and an unseated position on the valve seat to open the communicating paths to allow fluid to flow between the two by-pass passages; and control means for controlling the seatings and unseatings of the valve by selectively introducing working fluid at discharge pressure or suction pressure into the valve chamber.

In a preferred embodiment, the compressor is a totally enclosed compressor which is housed within a sealed shell, and the outsides of the scrolls are at suction pressure. The valve chambers comprise round holes cut in the top surface of the end plate of the stationary scroll, and the plate-shaped valves are in the form of thin metallic disks. The means for introducing working fluid into the valve chamber comprises a connecting pipe and a 3-way solenoid valve. The connecting pipe is connected between the valve chamber and the 3-way solenoid valve, and the 3-way solenoid valve is further connected to a source of working fluid at discharge pressure and a source of working fluid at suction pressure in the apparatus of which the compressor is a part.

There is no particular restriction on the number of first and second by-pass passages and valve chambers, but a preferred embodiment employs one pair of first by-pass passages, one pair of second by-pass passages, and one pair of valve chambers which are symmetrically disposed with respect to the center of the stationary scroll.

In one embodiment, both the first by-pass passage and the second by-pass passage are connected directly to the valve chamber. In another embodiment, the second by-pass passage is connected to the valve chamber via an annular space formed in the end plate of the stationary scroll around the first by-pass passage. The annular space houses a compression spring which biases the valve towards the unseated position on the valve seat so that the valve will not flutter when there is a small pressure difference between the inside of the valve chamber and the inside of the first by-pass passage.

BRIEF DESCRIPTION OF THE DRAWINGS

In the drawings, the same reference numerals indicate the same or corresponding parts.

DESCRIPTION OF THE PREFERRED EMBODIMENTS

Figure 1:
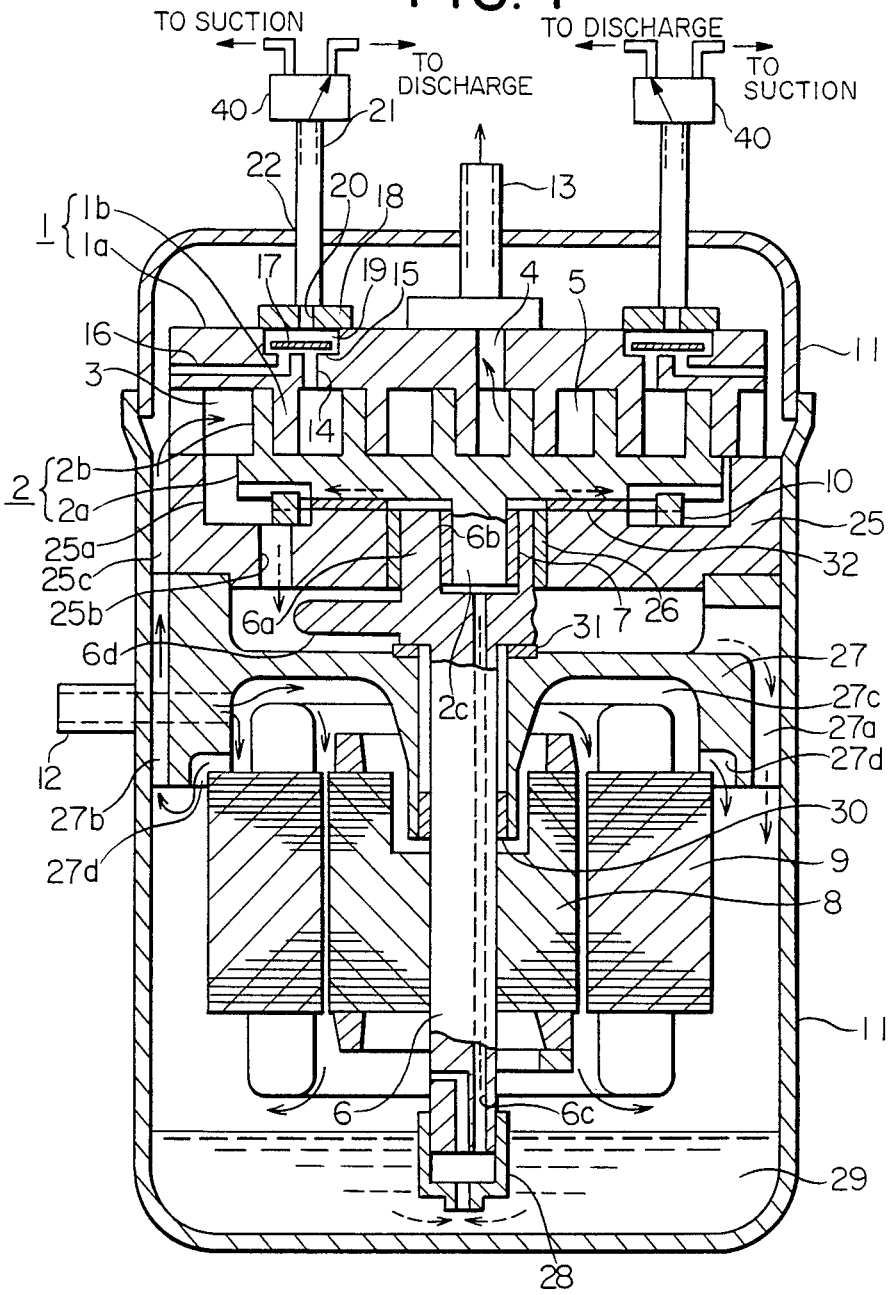
FIG. 1 is a vertical cross-sectional view of a first embodiment of a scroll-type compressor in accordance with the present invention.
Figure 2:
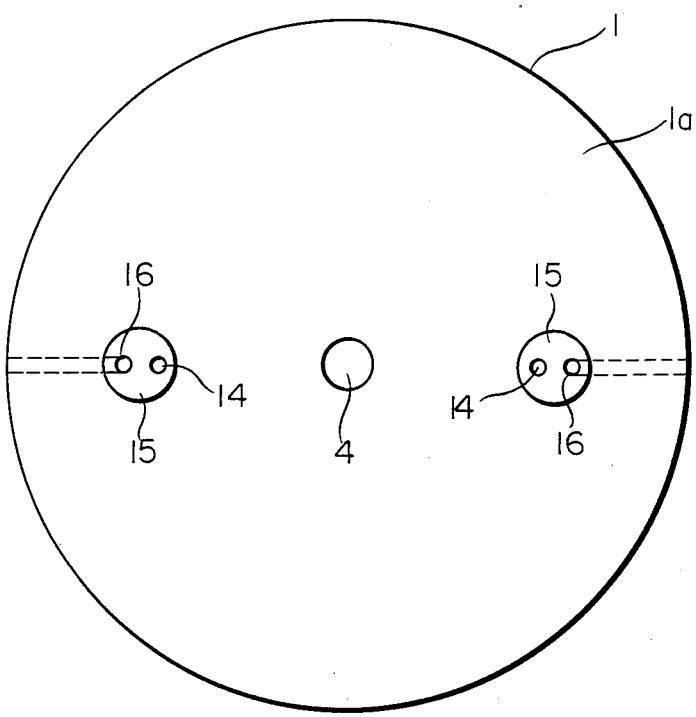
FIG. 2 is a plan view of the end plate of the stationary scroll of the embodiment of FIG. 1.

Hereinbelow, a number of preferred embodiments of a scrolltype compressor in accordance with the present invention will be described while referring to the accompanying drawings. FIGS. 1 and 2 illustrate a first embodiment in the form of a totally-enclosed compressor for an air conditioner. As shown in the figures, a stationary scroll 1 and a moving scroll 2 are housed within a hermetically-sealed shell 11. The stationary scroll 1 has a disk-shaped end plate 1a on the bottom side of which a perpendicularly-extending spiral wrap 1*b* is formed. The spiral wrap 1*b* has the transverse cross-sectional shape of an involute. Two diametrically-opposed suction ports 3 (only one of which is illustrated) are formed in the outer portions of the spiral wrap 1*b* of the stationary scroll 1. A discharge port 4, which extends from the bottom to the top surface of the end plate 1a, is formed at the center thereof. The discharge port 4 is connected to a discharge pipe 13 which penetrates the top of the sealed shell 11.

Likewise, the moving scroll 2 comprises a disk-shaped end plate 2a and a spiral wrap 2*b* which is formed on and extends perpendicularly from the top side of the end plate 2*a*. The spiral wrap 2*b* has the same traverse cross-sectional shape as the spiral wrap 1*b* of the stationary scroll 1, and it interfits with the stationary spiral wrap 1*b* so as to form a plurality of spiral compression chambers 5 which extend partway around the centers of the scrolls. A short shaft 2*c* is formed on the bottom surface of the end plate 2*a* and extends perpendicularly from the center thereof. The moving scroll 2 is eccentrically disposed with respect to the center of the stationary scroll 1.

The stationary scroll 1 is supported by a scroll support frame 25 which is secured to the inner surface of the sealed shell 11. The scroll support frame 25 has a circular depression 25*a* formed at its center. The depression 25*a* houses an upper thrust bearing 32 which bears the weight of the orbiting scroll 2, and a conventional Oldham coupling 10 which engages with grooves formed in the bottom surface of the end plate 2*a* of the orbiting scroll 2. The Oldham coupling 10 enables the orbiting scroll 2 to orbit around the center of the stationary scroll 1 without rotating on its own axis. A longitudinally-extending oil return hole 25*b* is formed in the scroll support frame 25 between the depression 25*a* and the bottom surface of the scroll support frame 25, and a longitudinally-extending suction passageway 25*c* is formed in its outer periphery, the upper end of the suction passageway 25*c* communicating with the suction ports 3.

A shaft support frame 27 is disposed immediately below the scroll support frame 25 and is secured to the inner surface of the sealed shell 11. The two frames 25 and 27 are connected with one another by a faucet joint. The shaft support frame 27 has a hole at its center through which a drive shaft 6 extends. The drive shaft 6 has a large-diameter portion 6*a* formed at its upper end, below which a counterweight 6d is formed. The large-diameter portion 6*a* is journalled by an upper journal bearing 26 which fits tightly into the hole at the center of the scroll support frame 25, while the midportion of the drive shaft 6 is journalled by a lower journal bearing 30 which fits tightly into the hole at the center of the shaft support frame 27. A longitudinally-extending eccentric hole 6*b* is formed in the top of the large-diameter portions 6a, and the shaft 2c of the orbiting scroll is journalled by a moving journal bearing 7 which fits tightly into the eccentrical hole 6b. An oil supply passageway 6c in the form of a longitudinally-extending, eccentric through hole is formed in the drive shaft 6 between the bottom end of the drive shaft 6 and the bottom end of the eccentric hole 6b. The lower end of the drive shaft 6 has an oil cup 28 fitted thereon. The oil cup 28 is immersed in lubricating oil 29 which fills the bottom of the sealed shell 11. A longitudinally-extending oil return hole 27a is formed in the outer periphery of the shaft support frame 27 between the top and bottom surfaces thereof. Furthermore, a longitudinally-extending suction passageway 27b is formed in the outer periphery of the shaft support frame 27. Its lower end opens onto the inside of the sealed shell 11 while its upper end communicates with suction passageway 25c.

The drive shaft 6 is rotated by an electric motor comprising a rotor 8 coaxially mounted on the lower end of the drive shaft 6, and a stator 9 supported by the shaft support frame 27.

Working fluid to be compressed is introduced into the compressor through a suction pipe 12 which is mounted on the outside of the sealed shell 11 and communicates with a cavity 27c formed in the underside of the shaft support frame 27 above its motor. As shown by the solid arrows in FIG. 1, working fluid flows from the suction pipe 12 into the cavity 27c. Some of the working fluid flows down the length of the motor to the bottom of the sealed shell 11, while some exits from the cavity 27c via a plurality of suction passageways 27d which are formed in the inner walls of the shaft support frame 27 between the cavity 27c and the outside of the motor. After cooling the motor windings, the working fluid flow through suction passageway 27b and 25c into the suction ports 3.

A pair of longitudinally-extending first by-pass passages 14 and a pair of radially-extending second by-pass passages 16 are symmetrically formed inside the end plate 1a of the stationary scroll 1 on opposite sides of the discharge port 4. The lower end of each of the first by-pass passages 14 opens onto the lower surface of the end plate 1a inside one of the compression chambers 5, while the upper end opens onto the lower surface of one of two valve chambers 19 in the form of round holes which are cut in the top surfaces of the end plate 1a. The lower surface of each valve chamber 19 serves as a valve seat 15 for a disk-shaped valve 17. The valve 17 is made of hardened cold rolled steel sheet, which is typically used as a valve material for refrigeration compressors. The outer end of each of the second by-pass passages 16 opens onto the outer periphery of the stationary end plate 1a, which is at suction pressure, while the inner end opens onto the valve seat 15 adjacent to the first by-pass passage 14. The dimensions of each valve 17 are such that when it seats on the valve seat 15, working fluid is prevented from flowing between the first by-pass passage 14 and the second by-pass passage 16. Each valve 17 can move between a seated position in which its front side (the lower side in FIG. 1) is seated on the valve seat 15, and an unseated position in which the valve 17 is unseated and working fluid can flow from the first by-pass passage 14 to the second by-pass passage 16.

The upper end of each valve chamber 19 is covered by a valve chamber cover 18 having a through hole 20 formed at its center. The inside of each valve chamber 19 communicates through the hole 20 with the inside of a connecting pipe 21 which passes through a hole 22 formed in the lid of the sealed shell 11. The lower end of each connecting pipe 21 is secured to one of the valve chamber covers 18 and the midportion is secured to the inside of one of the holes 22 in the shell 11 by brazing or other suitable method. The connecting pipes 21 can be made to communicate with a lowpressure portion of the air conditioner which is at suction pressure or with a high-pressure portion at discharge pressure by turning 3-way solenoid valves 40.

The operation of the illustrated embodiment is as follows. When the drive shaft 6 is rotated by the motor, the orbiting scroll 2 is made to orbit around the center of the stationary scroll 1 while being prevented from rotating on its axis by the Oldham coupling 10. Working fluid, shown by the solid arrows, is drawn into the sealed shell 11 through the suction pipe 12, and after cooling the motor windings, it enters into the compression chambers 5 formed between the two scrolls via the suction passageways 27b and 25c and the suction ports 3. As the orbiting scroll 2 orbits, the compression chambers 5 are progressively moved around the center of the stationary scroll 1, and as they are moved they decrease in volume, thereby compressing the working fluid. When the working fluid reaches the center of the stationary scroll 1, it is discharged under pressure through the discharge port 4 and the discharge pipe 13 to a high-pressure portion of the air conditioner of which the compressor is a part.

At the same time, the rotation of the drive shaft 6 causes lubricating oil 29 to be drawn upwards from the bottom of the sealed shell 11 through the oil supply passageway 6c. As shown by the dashed arrows in FIG. 1, the lubricating oil 29 is supplied to the Oldham coupling 10 by way of the eccentric hole 6b and the upper thrust bearing 32, and it then returns to the bottom of the sealed shell 11 via oil return holes 25b and 27a formed in the scroll support frame 25 and the shaft support frame 27, respectively.

When the compressor is to be operated at full capacity, the unillustrated 3-way solenoid valves which are connected to the connecting pipes 21 are turned such that high-pressure working fluid at discharge pressure is introduced into the valve chambers 19 to the rear of the valves 17 via the connecting pipes 21. As the discharge pressure is higher than the pressure of the working fluid in the compression chambers 5 into which the lower ends of the first by-pass passages 14 open, the difference in the pressure acting on the front and rear sides of the valves 17 causes them to be pressed downwards and firmly seat on the valve seats 15. When the valves 17 are seated, no working fluid can pass between the first by-pass passages 14 and the second by-passes 16. Therefore, all the working fluid which is introduced into the compression chambers 5 is compressed and discharged through the discharge port 4, and the compressor runs at maximum capacity.

On the other hand, the compressor can be made to operate at partial capacity by turning the unillustrated 3-way solenoid valves so that low-pressure working fluid at suction pressure is introduced into the valve chambers 19 to the rear of the valves 17 via the connecting pipes 21. The pressure in the compression chambers 5 into which the first by-passes open 14 is somewhat higher than suction pressure, and therefore the valves 17 are pressed upwards by the pressure difference until they contact the lower sides of the valve chamber covers 18. When the valves 17 are moved upwards and unseat from the valve seats 15, working fluid flows from the compression chambers 5 through the first by-pass passages 14, the valve chambers 19, and the second by-pass passages 16 to the outside of the stationary scroll 1. As a result, the pressure in the compression chambers 5 with which the first by-passes 14 communicate is reduced to substantially suction pressure, and compression takes place only in those compression chambers 5 which are located closer to the center of the stationary scroll 1 and do not communicate with the first by-pass passages 14. Therefore, the capacity of the compressor is reduced.

The volume of working fluid which is exhausted to the outside of the stationary scroll 1 through the by-pass passages can be adjusted by varying the diameter, the number, and the locations of the first by-pass passage 14. The first by-passes 14 should communicate with a pocket of working fluid in a completely enclosed compression chamber, i.e., a pocket of working fluid which does not communicate with either the suction ports 3 or the discharge port 4. The closer are the first by-pass passages 14 to the discharge port 4, the later will be the start of compression and the lower will be the compression ratio.

As the scrolls define a plurality of symmetrical pairs of compression chambers 5, it is necessary to have at least one pair of symmetrically-disposed first by-pass passages 14, but more than one pair of by-pass passages may be employed. Furthermore, in this embodiment, each valve chamber 19 is connected to one first bypass passages 14 and one second by-pass passages 16, but it is also possible for a single valve chamber 19 to be connected to a plurality of first by-pass passages 14 and a single second by-pass passage 16.

Figure 3:
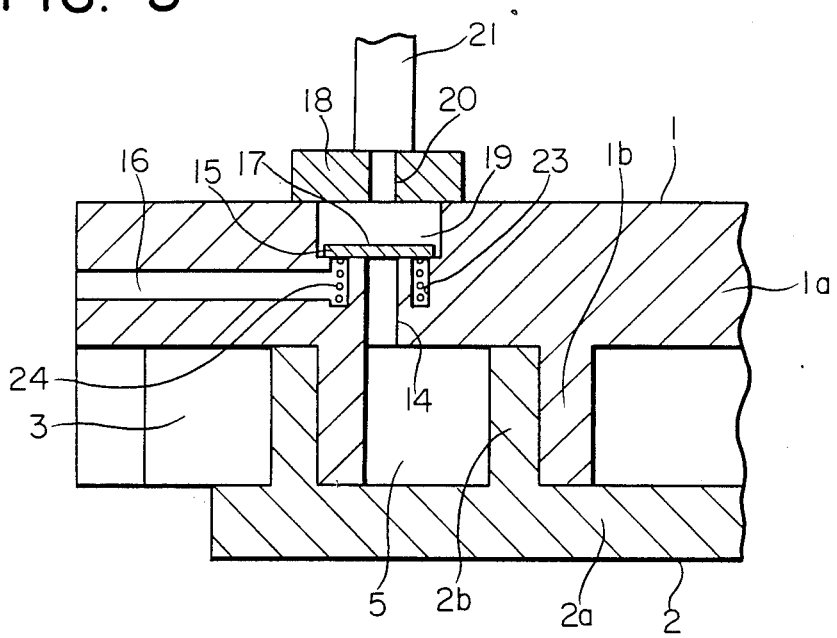
FIG. 3 is vertical cross-sectional view of a portion of the stationary and orbiting scrolls of a second embodiment of the present invention, illustrating the valve chamber.
Figure 4:
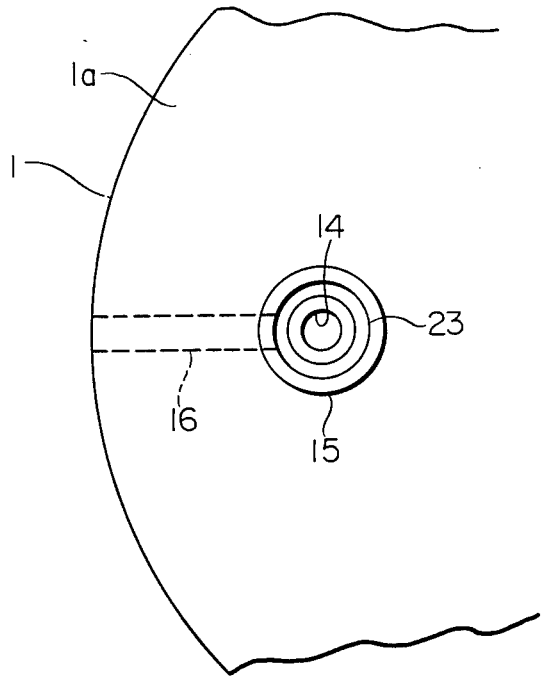
FIG. 4 is a plan view of a portion of the end plate of the stationary scroll of the embodiment of FIG. 3.

FIGS. 3 and 4 illustrate a second embodiment of this invention, FIG. 3 being a vertical cross-sectional view of a portion of the embodiment, and FIG. 4 being a plan view of a portion of the end plate 1*a* of FIG. 3. In this embodiment, the upper portion of a first by-pass passage 14 is surrounded by an annular connecting space 23. The upper end of the connecting space 23 opens onto a valve seat 15, and the inner end of a second by-pass passage 16 opens onto the side of the connecting space 23. The connecting space 23 houses a helical compression spring 24 which contacts the front side of a disk-shaped valve 17 and exerts an upwards biasing force on it. Although not shown, the other half of the end plate 1*a* on the other side of the discharge port 4 has a similar structure. The structure of this embodiment is otherwise identical to that of the previous embodiment.

The operation of this embodiment is basically the same as that of the previous embodiment. When the connecting pipe 21 is made to communicate with a high-pressure portion of the air conditioner by turning an unillustrated 3-way solenoid valve which is connected to the connecting pipe 21, working fluid at discharge pressure presses the valve 17 downwards against the force of the spring 24, thereby seating the valve 17 and sealing off the first by-pass passage 14 and the connecting space 23. When the connecting pipe 21 is made to communicate with a low-pressure portion of the air conditioner by turning the 3-way solenoid valve, the spring 24 pushes the valve 17 firmly against the valve chamber cover 18. Working fluid is then able to pass through the first by-pass passage 14 into the second by-pass passage 16 via the valve chamber 19 and the connecting space 23, and the upwards biasing force exerted by the spring 24 prevents the valve 17 from fluttering when there is only a small pressure difference between the inside of the first by-pass passage 14 and the low-pressure working fluid in the upper portion of the valve chamber 19.

As is clear from the above description, a scroll-type compressor in accordance with the present invention employs an extremely simple valve mechanism for opening and closing by-pass passages which extend between the compression chambers of the compressor and a portion of the compressor which is at suction pressure. The valve mechanism is therefore not only extremely reliable but is also inexpensive to manufacture. Furthermore, as the valve mechanism is housed within the end plate of the stationary scroll, the clearance between the top surface of the stationary scroll and the sealed shell which houses the scroll can be very small, and a sealed shell for a conventional scroll-type compressor can be employed.

Although a scroll-type compressor of the present invention was described with respect to its use as an air conditioner compressor, it can of course be employed in other types of devices requiring a variable-capacity compressor.

What is claimed is:

1. A scroll-type compressor comprising:

a stationary scroll including a disk-shaped, stationary end plate having surfaces and a discharge port formed at a center of said stationary end plate, and a stationary spiral wrap extending perpendicularly from one surface of said stationary end plate and curving outwardly from the center of said stationary end plate in the shape of a spiral;

an orbiting scroll including a disk-shaped moving end plate having surfaces and a central rotating axis, and a moving spiral wrap extending perpendicularly from one surface of said moving end plate and curving outwardly from the central rotating axis of said moving end plate in the shape of a spiral, said stationary scroll and said orbiting scroll being engaged with one another with said stationary and moving end plates parallel and said spiral wraps interfitting with one another so as to define a plurality of compression chambers;

means for orbiting said orbiting scroll about the center of said stationary end plate while preventing said orbiting scroll from rotating about the central rotating axis;

a valve chamber formed in said stationary end plate and having a valve seat;

a first longitudinally extending by-pass passage formed in said stationary end plate and providing a longitudinal path for communicating between said valve chamber and said compression chambers;

a second radially extending by-pass passage formed in said stationary end plate and providing a radial path for communicating between said valve chamber and an exterior of said stationary end plate; and a plate-shaped valve disposed entirely inside said valve chamber to move between a seated portion on said valve seat to close the communicating paths provided by said first and second by-pass passages and an unseated position on said valve seat to open the communicating paths to allow fluid to pass from said first by-pass passage to said second by-pass passage.

2. A scroll-type compressor as claimed in claim 1 further comprising a sealed shell housing said scrolls and having suction pressure at least in the periphery of said stationary scroll, wherein said second bypass passage extends to a portion of the periphery of said stationary scroll which is at suction pressure.

3. A scroll-type compressor as claimed in claim 1 further comprising an annular space formed in said stationary end plate around said first bypass passage and communicating between said valve chamber and said second by-pass passage, and a compression spring housed in said annular space and having one end pressing against a front side of said valve so as to bias said valve towards the unseated position on said valve seat.

4. A scroll-type compressor as claimed in claim 1, wherein the compression chamber with which said first by-pass communicates does not communicate with said discharge port.

* * * * *